US010342304B1

(12) United States Patent
Vasnin

(10) Patent No.: US 10,342,304 B1
(45) Date of Patent: Jul. 9, 2019

(54) APPARATUS, METHOD, AND KIT FOR AESTHETIC EAR PIERCING PLACEMENT

(71) Applicant: Leigh Whelan Vasnin, Houston, TX (US)

(72) Inventor: Leigh Whelan Vasnin, Houston, TX (US)

( * ) Notice: Subject to any disclaimer, the term of this patent is extended or adjusted under 35 U.S.C. 154(b) by 248 days.

(21) Appl. No.: 14/866,938

(22) Filed: Sep. 26, 2015

(51) Int. Cl.
*A44C 7/00* (2006.01)
*A61B 17/34* (2006.01)

(52) U.S. Cl.
CPC ..... *A44C 7/001* (2013.01); *A61B 17/3403* (2013.01); *A61B 2017/3411* (2013.01)

(58) Field of Classification Search
CPC ..... A44C 7/001; A44C 7/00; A44C 7/003; A44C 15/005; A44C 15/0035; A61B 17/3403; A61B 2017/3411; A61B 2017/3405; A61B 2017/3407; A61B 2017/3409; A61B 2090/395; A61B 2090/3904; A61B 2090/3908; A61B 2090/3937; A61B 90/39; A61B 5/6841; A61B 5/6842; A61F 2013/00387; A61F 2013/00153; A61F 2013/00378; A61M 5/427; A47G 1/205
USPC ..... 606/188; 604/116
See application file for complete search history.

(56) References Cited

U.S. PATENT DOCUMENTS 3,542,022 A 11/1970 Bartnik
4,228,796 A * 10/1980 Gardiner ..... A61M 5/427 604/116
4,362,157 A * 12/1982 Keeth ..... A61M 5/427 604/116
4,427,005 A 1/1984 Tener
4,580,561 A 4/1986 Williamson
4,736,526 A 4/1988 Hsia
5,123,907 A * 6/1992 Romaine ..... A61B 17/32053 604/115
5,638,701 A 6/1997 Dempsey
5,669,929 A * 9/1997 Reil ..... A44C 7/001 206/471
5,769,995 A * 6/1998 Greyerbiehl ..... A44C 7/00 156/250
6,003,333 A * 12/1999 Stevens ..... A44C 7/00 63/12

(Continued)

OTHER PUBLICATIONS

Studex, http://blog.esslinger.com/studex-earpeircing-directions;Jun. 12, 2014.*

(Continued)

*Primary Examiner* — Dianne Dornbusch
(74) *Attorney, Agent, or Firm* — Karen B. Tripp

(57) ABSTRACT

A method with apparatus and kit for practicing the method that provides a reliable determination of desired earlobe piercing position by giving the user a preview of an earring in the location. The user tests a variety of sized discs that mimic stud earrings on the area to be pierced to determine the most visually pleasing size relative to the area. Once the desired size is chosen, the user then positions and repositions the disc on the site until the disc is in the optimal position visually. A mark is then made on the ear through one or more holes or perforations in the disc. The disc is then removed and the ear is pierced at or where indicated by the mark.

19 Claims, 3 Drawing Sheets

(56) References Cited

U.S. PATENT DOCUMENTS

| | | | | |
|---|---|---|---|---|
| 6,053,931 | A * | 4/2000 | Lizcano | A44C 7/001 606/188 |
| 6,626,865 | B1 * | 9/2003 | Prisell | A61B 17/32053 604/116 |
| 8,133,201 | B1 | 3/2012 | Hurtado | |
| 8,740,926 | B2 | 6/2014 | Blomdahl et al. | |
| 2004/0147846 | A1 * | 7/2004 | Mueller, Jr. | A61B 90/90 600/476 |
| 2005/0148935 | A1 | 7/2005 | Dimitrova et al. | |
| 2007/0038180 | A1 * | 2/2007 | Sinha | A61B 17/3415 604/117 |
| 2007/0237307 | A1 * | 10/2007 | Suddaby | A61B 90/39 378/205 |
| 2008/0132907 | A1 * | 6/2008 | Mueller | A61B 17/0401 606/116 |
| 2008/0146963 | A1 * | 6/2008 | Crocker | A61B 90/11 600/567 |
| 2008/0262424 | A1 * | 10/2008 | van't Hooft | A61N 5/1027 604/116 |
| 2010/0061521 | A1 * | 3/2010 | Standar | A61B 6/0414 378/162 |
| 2012/0221036 | A1 * | 8/2012 | Ahmann | A61B 19/54 606/186 |

OTHER PUBLICATIONS

Studex, http://www.studexuk.com/acatalog/Medisept-Nose-Piercing-Starter-Kit.html;2014-2017.*

* cited by examiner

APPARATUS, METHOD, AND KIT FOR AESTHETIC EAR PIERCING PLACEMENT

BACKGROUND OF THE INVENTION

1. Field of the Invention

The present invention relates to an apparatus and a method for facilitating improved ear piercing placement.

2. Description of Relevant Art

Persons have been piercing their ears to facilitate the wearing of jewelry on and/or attached to their ears for many years. Placing a hole through the ear for fitting jewelry connectors or holders allows for more comfortable and secure holding of earrings or other ear jewelry, particularly on the earlobes, than clips or similar pinching type holders.

The placement of the piercing of the ears and earlobes has generally been an imprecise art. Ears and earlobes, while generally similar from person to person, vary widely in their exact appearance and size, particularly with respect to length and width in relation to the ear canal and their overall look with respect to the ear and the face.

Currently ears are marked for piercing typically by a third party who marks a small dot on the ear where it is believed the piercing should be made. In the case where both ears are to be pierced, the third party compares the marked ear and the unmarked ear, and then marks that unmarked ear in an approximation of similar placement to the first marked ear. The third party then looks to see if the marks "match" on either side of the face. The person whose ears are to be pierced then approves the mark(s). Upon approval, the piercing is made.

It is extremely difficult to determine the optimal location for the piercing using just this small marking. Both accuracy and esthetics are involved. The piercing location must be accurately placed, for example in the center of the area to be pierced. This problem is compounded when piercing both ears with the desire that the piercings be symmetrical. The piercings must not only appear to be level across the face (one not appear higher or lower than the other), but must also both appear to be of equal distance from the face. This must be accomplished on two ears that generally are asymmetrical, unevenly perched on the head, and with varying degrees of angle. Compensation can be made for differences by making small adjustments in the site of the piercing, but not so much that either piercing looks unbalanced relative to its own location on the ear. Mechanical measurements may improve accuracy. Accuracy, however, does not guarantee visual esthetics. There is no way to be sure that the accurate location of a small dot will translate into an esthetically pleasing location for an earring with visual mass and weight. It is impossible to address all these considerations by estimating with a small dot.

There continues to be a need for better ways to facilitate improved ear piercing placement, and particularly improved earlobe piercing placement—ways that not only provide accuracy, but that also take into account aesthetics.

SUMMARY OF THE INVENTION

The present invention provides a new and improved method, and an apparatus and kit for practicing the method, that provides a more reliable determination of the ideal or at least preferred or desired, ear piercing position by giving the user a preview of an earring in the location. With this invention, the user is presented with discs that mimic a stud earring. The user may test a variety of sized discs on the area to be pierced to determine the most visually pleasing size relative to the area. Once the desired size is chosen, the user then positions and repositions the disc on the site until it is in the optimal position visually. The user thus knows how a stud earring of that size (as opposed to just a small dot) will look on the ear in that position. A mark is then made on the ear through one or more holes or perforations in the disc. The disc is then removed and the ear is pierced at or where indicated by the mark. With this preview of the earring, the user is better assured that the piercing is going to be both accurate and esthetically pleasing.

BRIEF DESCRIPTION OF THE DRAWINGS

For a better understanding of the invention, reference should be had to the following detailed description taken in conjunction with the drawings, in which.

DESCRIPTION OF THE PREFERRED EMBODIMENTS

Referring now more particularly to the Figures, therein is illustrated a new and improved method, apparatus, and kit to facilitate desired placement of ear piercing. The Figures depict example embodiments for earlobe piercing, but one of ordinary skill in the art will understand that the teachings herein may similarly be applied to piercing other portions of the ear, or even another part of the head or face. As used herein, desired placement is the placement determined by the user to be the most aesthetically pleasing to the user. Usually, the user is the person whose ears are to be pierced, but the user may alternatively be someone whom that person (whose ears are to be pierced) trusts with the decision on his or her behalf. As used herein, for convenience, the term "user" shall be understood to include that trusted person as well as the person whose ears will be pierced, unless the contrary is indicated.

Figure 1A:
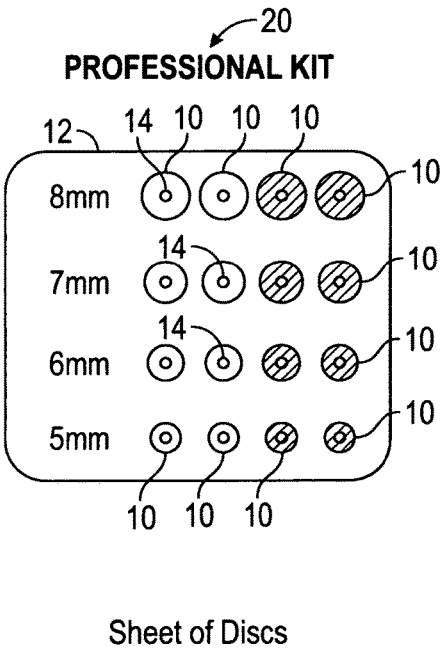
FIGS. 1A and 1B illustrate two different versions or embodiments of a kit for use in applying the method of the invention, a professional kit and a consumer kit.
Figure 1B:
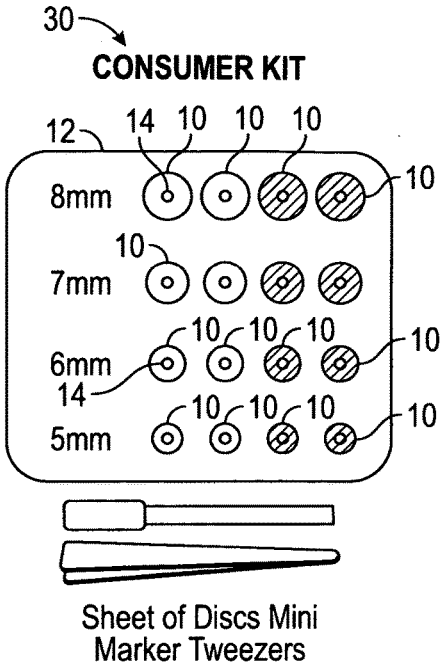
Figure 3:
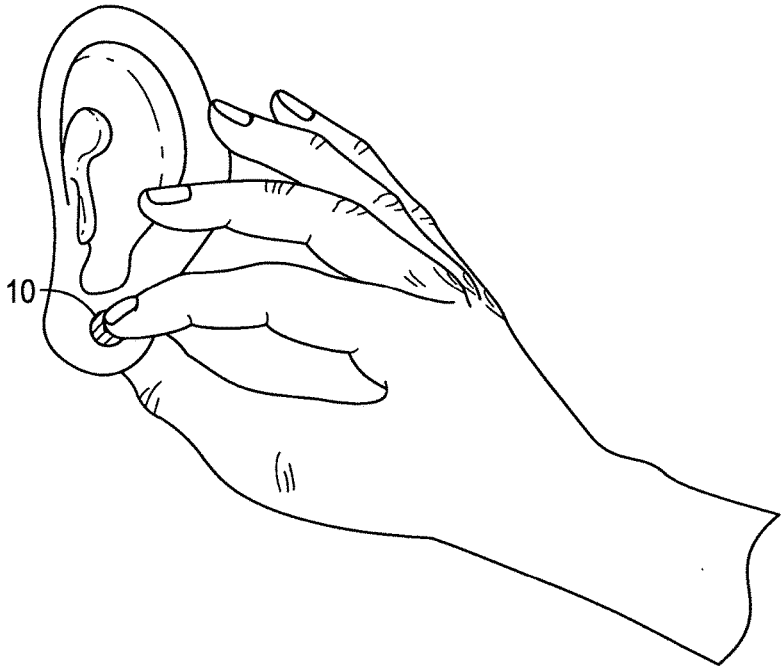
FIG. 3 illustrates one embodiment of applying a disc to an earlobe according to the method of the invention.
Figure 4:
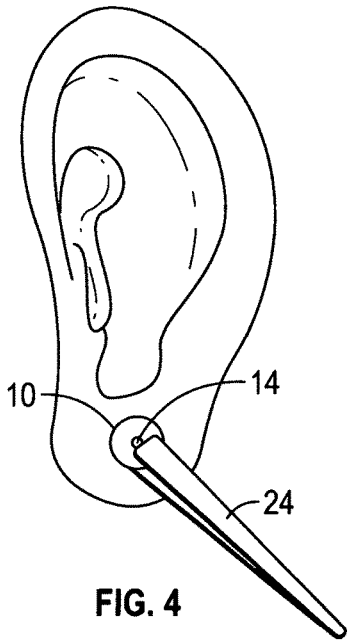
FIG. 4 illustrates an alternative embodiment of applying a disc to an earlobe according to the method of the invention.

According to the method of the invention, and referring to FIGS. 1A and 1B, a user selects a pair of discs 10 from a sheet 12 of discs and places a disc 10 on each earlobe, by hand as shown in FIG. 3 or with a tool such as tweezers 24 as shown in FIG. 4. Alternatively, and particularly when piercing of only one earlobe is desired, the user selects one disc 10 from a sheet 12 of discs and places that disc 10 on one earlobe, by hand as shown in FIG. 3 or with a tool such as tweezers 24 as shown in FIG. 4.

In one embodiment, disc 10 is "self adhesive" at least with skin, that is, disc 10 is comprised of a material that readily adheres to skin while also being readily removable from skin, preferably with pressure, lifting, pulling, or tugging and without need for application of a remover material such as water, alcohol, or oil. In an alternative embodiment, disc 10 has adhesive compatible with skin on one side and the adhesive is preferably reusable, so that the user can position and reposition the selected disc 10 on the earlobe until the desired location, providing the most aesthetically pleasing look to the user, is found. An adhesive is considered compatible with skin if the adhesive does not cause skin irritation and is able to hold disc 10 to the skin of the earlobe (at least sufficiently long as to fulfill the purpose of the invention), that is, maintains sticking characteristics when in contact with skin, while also being easily removable preferably with pressure, lifting, pulling, or tugging and without need for application of a remover material such as water, alcohol, or oil. In one embodiment, the adhesive is of a type that is easily protected by sheet 12 and that also removably adheres to sheet 12 while still being effective in adhering to the skin of the earlobe. In another embodiment, the adhesive is of a type that is protected by a separate covering and the covering is attached to sheet 12. In still another embodiment, sheet 12 is not used at all and the discs 10 are separately wrapped and made available either individually or grouped in a package. In one embodiment, the adhesive is applied by the user separately to the disc 10 at the time of use and the disc 10 is not provided with adhesive already thereon.

While it is contemplated that a user may make the determination of the location for earlobe piercing within a few minutes, it is also contemplated that the user may wish to make the determination over a period of days. A suitable adhesive for the discs 10 according to the invention preferably will allow adherence of the disc 10 to an earlobe for several hours or days, although extended wear—such as for over about a week—is not recommended as such extended wear could irritate the skin on the earlobe, depending on the adhesive used. A suitable adhesive for the discs 10 may but is not required to provide adherence during strenuous exercise, sweating, swimming or showering.

Disc 10 is preferably flexible for easier positioning on the earlobe and comprised of one or more materials that enable the disc 10 to readily adhere to the skin of an earlobe, while also being readily removable, as discussed above. The material comprising the disc 10 does not easily tear and is not readily stretchable so that the appearance of the disc is consistent during use—as it is being moved about the earlobe, positioned and repositioned thereon. The material comprising the disc 10 is also sufficiently light in weight as to adhere well to the earlobe with minimal adhesive if any adhesive is needed. The material comprising disc 10 also is substantial enough that it can maintain the integrity of its shape even though perforated, as shown for example in FIG. 2. Materials that are considered particularly suited for comprising disc 10 include without limitation various plastics, polymers, silicones, acrylics, acrylates, and vinyls that meet these characteristics, and that are also generally inert and nonallergenic. Alternative materials that may be suitable for disc 10 include for non-limiting example paper, cardboard, hydrogels, and thin metals such as, for non-limiting example, foils of aluminum, tin, or copper. Disc 10 is preferably not clear and most preferably is colored or has a natural color so that it may be easily seen on the earlobe for positioning.

According to the invention, once positioned on the earlobe, as shown in FIGS. 3 and 4, disc 10 may be repositioned at various places on the earlobe so the user can determine the desired location—the most aesthetically pleasing position for an earring on that particular earlobe for that particular face, and when viewed with the corresponding earlobe. In embodiments of the invention where a disc 10 is placed on each earlobe, the discs 10 are viewed at the same time and compared one to another to determine the best or most desired position or location of the disc 10 on each earlobe.

In one embodiment, the user repeats this procedure with discs 10 of different sizes on sheet 12 until the user determines the size that the user considers most aesthetically pleasing for the user's ear and face. In an alternative embodiment, the user first decides on a preferred size of disc 10 to use, and then positions and repositions that sized disc 10 to determine the most desired location or position of the disc 10 on the earlobe (or earlobes). FIGS. 1A and 1B show four different sizes for example, discs having a diameter of 5 mm, 6 mm, 7 mm, and 8 mm respectively. These sizes are typical or common for stud earrings but other sizes or more sizes could be used. Preferably, when planning to pierce both earlobes, the size discs used on each ear are the same and the disc shape and color are the same, to avoid distractions or distortions that may result from comparing the look of different discs one to another on ears adjacent a face.

Figure 2A:
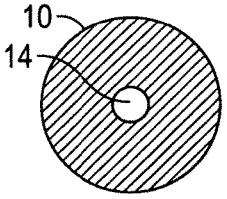
FIGS. 2A, 2B, 2C, 2D, and 2E illustrate five different variations or embodiments of the apparatus of the invention, discs, which may be used in the method of the invention.
Figure 2B:
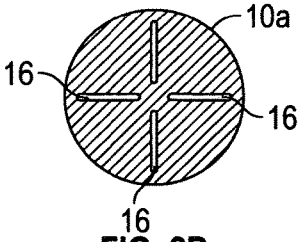
Figure 2C:
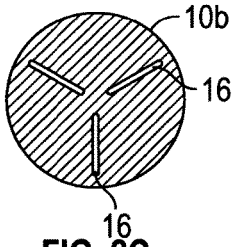
Figure 5A:
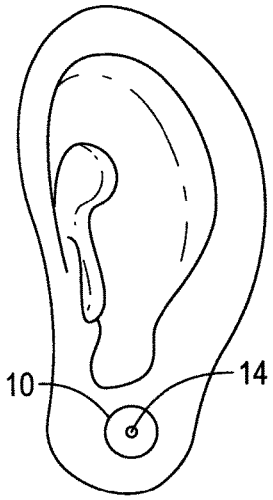
FIGS. 5A, 5B, and 5C illustrate three of several steps of one embodiment of the method of the invention.
Figure 5B:
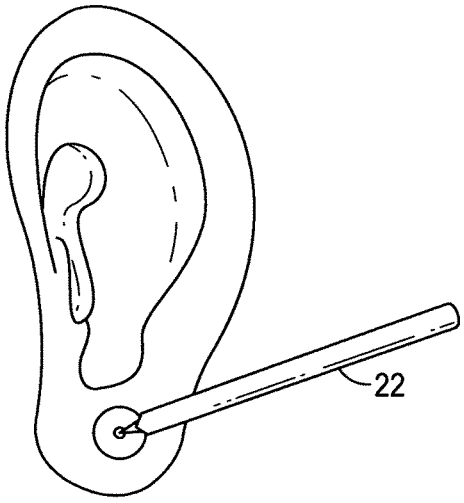
Figure 5C:
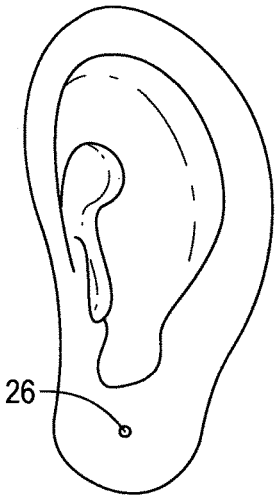

Once the desired location for the disc 10 on the earlobe or a pair of discs 10 on both respective earlobes of the user is determined, then the disc 10 is used as a template on the earlobe for marking or otherwise indicating the desired position of piercing of the earlobe. In one embodiment, as shown in FIGS. 1A, 1B, and 2A, disc 10 has a small hole 14 in its center, sufficient for inserting a marker 22 such as a pen or pencil tip through to mark the earlobe as shown in FIG. 5. The minimal size hole needed for such insertion of a marker 22 is desired, as the larger the hole 14, the less precise the positioning of the mark will be on the earlobe. The marker ink 26 should not be easily or readily erasable with alcohol so that the mark lasts on the earlobe to serve as a piecing guide after the skin is cleaned with alcohol prior to the piercing.

Figure 2D:
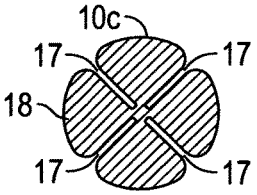
Figure 2E:
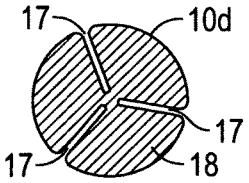

In some alternative embodiments of the invention, also as shown in FIGS. 2B, 2C, 2D, and 2E, the respective discs 10*a*, 10*b*, 10*c*, and 10*d* of the invention each have slits perforating the discs and extending radially from their center and equidistant one from the other, instead of a center hole 14 as for disc 10. The invention contemplates a minimum of two such slits and FIGS. 2B and 2C respectively show for non-limiting example disc 10*a* with four slits 16 and disc 10*b* with three slits 16, none of which slits 16 extend to or through the outer edge or periphery of the disc 10*a* or 10*b*. FIGS. 2D and 2E also respectively show for non-limiting example disc 10*c* with four slits 17 and disc 10*d* with three slits 17 where all of the slits 17 extend to and through the outer edge or periphery 18 of the disc 10*c* and 10*d* respectively. These alternative discs 10*a*, 10*b*, 10*c*, and 10*d* are readily substituted for disc 10 for use as a template in the invention. The slits 16 in discs 10*a*, 10*b*, and the slits 17 in discs 10*c*, and 10*d*, effectively point to the center of the disc. Instead of marking the disc center on the earlobe with a marker 22, the user marks through the slits so that the markings on the earlobe effectively point to the desired location for piercing the earlobe. As with the small center hole 14 in disc 10, the slits 16 in discs 10*a*, 10*b*, and the slits 17 in discs 10*c*, and 10*d* are minimal width for more precise marking.

After marking the earlobe with a marker 22 through the center hole 14 in disc 10 as shown in FIG. 5, the disc 10 is removed, and the ear is ready for piercing at the position marked. In an alternative embodiment, after marking the earlobe with a marker 22 through the slits 16 in disc 10*a* (or 10*b*, or through the slits 17 in disc 10*c* or 10*d*), the disc 10*a* (or 10*b*, 10*c*, or 10*d* respectively) is removed, and the ear is ready for piercing at the central position to which the markings are effectively pointing—the position that was the center of the disc. In one embodiment, where disc 10 is used and the marking of the desired location was through the center hole 14 in the disc 10, the disc 10 is left in place on the earlobe for use as a guide for the piercing of the earlobe at that desired location. In another embodiment, where disc 10 is used, the disc 10 is left in place on the earlobe for use as a guide for the piercing of the earlobe at the desired location and the earlobe is not marked through the center hole 14. When disc 10 is left in place for use as a guide for the piercing, a needle or other small and precise tool that can easily fit through hole 14 in disc 10 is used for the piercing. Disc 10 is then typically removed after the piercing and prior insertion of an earring. However, in one embodiment, disc 10 may be comprised of a material that dissolves over time, and in such case, the disc 10 may be left in place after the piercing.

To facilitate use of the method of determining the desired location for ear piercing as taught herein, the present invention provides kits 20 and 30 as shown respectively for example in FIGS. 1A and 1B. At a minimum, the kit of the invention comprises at least one disc for use when piercing of one ear is contemplated and at least a pair of like discs for use when piercing of both ears is contemplated. Preferably, the kit comprises multiple discs or pairs of discs, as illustrated for example in FIGS. 1A and 1B. Professional users or users who use the invention for multiple persons, may typically use such a kit 20. In an alternative embodiment, professional users may use a kit (not shown) providing multiple sheets of the same sized discs (all 8 mm discs for example, or at least one sheet of all 8 mm discs, at least one sheet of all 7 mm discs, and at least one sheet of all 6 mm discs, for example). When the kit comprises discs that are not self adhering, either because the material comprising the discs lacks such a characteristic or because the discs lack an added adhesive on at least a portion of at least one side, then the kit may further comprise an adhesive which may be added to the back of the discs. Optionally, the kit may further contain tools useful in the method such as a marker 22 and/or tweezers 24. A mirror might also optionally be included. First time users of the invention and one-time users of the invention may typically use such a kit 30.

As illustrated in the Figures herein, the discs of the invention are generally round, flat, and thin, consistent with the general definition of the term "discs." However, the advantages of the invention may also be realized if the "discs" are instead for non-limiting example square in shape. Other shapes, alternative to common disc shapes, might also be used for the "discs," but a regular thin flat shape as opposed to an irregular thin flat shape will be easier to use and will likely give the better results. When an irregular shape is used, care will need to be taken to match the direction of the shape when positioning it on both ears. Such alternative shapes are considered to be within the description when reference is made to "discs" herein.

The invention is described for use of the discs of the invention for piercing a single hole in a single earlobe or a single hole in each of a pair of earlobes. The invention might be similarly used as described for piercing multiple holes in an earlobe, positioning as many discs on an earlobe as one desires piercings and determining placement of the piercings one with respect to the other. The invention might also be used for adding one or more piercings to an ear or earlobe already pierced in at least one location. In such event, an earring is positioned in the existing hole and the disc(s) of the invention is positioned with respect to that existing piercing. The invention is also described for piercing the earlobe. The invention could be adapted however for piercing other parts of the ear, or even other parts of the head or face, as noted above.

The description should not be construed as limiting the scope of the invention but as merely providing illustrations of some of the presently preferred embodiments of the invention. Persons skilled in the art will understand that the method described herein may be practiced, including but not limited to, the embodiments described. Further, it should be understood that the invention is not to be unduly limited to the foregoing apparatus and kits which have been set forth for illustrative purposes. Various modifications and alternatives will be apparent to those skilled in the art without departing from the true scope of the invention, as defined in the following claims. While there has been illustrated and described particular embodiments of the present invention, it will be appreciated that numerous changes and modifications will occur to those skilled in the art, and it is intended in the appended claims to cover those changes and modifications which fall within the true spirit and scope of the present invention.

Thus, the scope of the invention should be determined by the appended claims and their legal equivalents, rather than by the examples given.

I claim:

1. A method for determining desired placement for piercing an ear, or other part of the face or head, of a user, for the wearing or attachment of jewelry, the method comprising:

selecting a first disc simulating a stud earring but having a central hole indicating the center of the disc or slits perforating the disc and pointing toward the center of the disc;

positioning the disc on the first ear, or said other part to be pierced, so that the disc adheres to the ear, or said other part;

viewing the ear, or said other part, wearing the disc to determine whether the disc is positioned at a desired location for the piercing of the ear, or said other part, for the wearing or attachment of jewelry;

adjusting or repositioning the disc on the ear; or said other part, as needed, until the disc is positioned at a desired location for the piercing of the ear, or said other part, for the wean ng or attachment of jewelry;

and when the disc is positioned at a desired location for the piercing, marking the ear, or said other part, through the hole or slits to indicate the location for piercing the ear, or said other part, at said marking, for the wearing or attachment of jewelry at said location.

2. The method of claim 1 wherein both first and second ears of the user will be pierced for the wearing or attachment of jewelry, and the method further comprises:

selecting a second disc having the same appearance, size and shape as the first disc;

positioning the second disc on the second ear so that the disc adheres to the second ear;

viewing the second ear with the second disc while viewing the first ear with the first disc and comparing the location of the respective discs on the respective ears and one to another with respect to the overall look on the face to determine whether the second disc is positioned at a desired location for the piercing of the second ear, for the wearing or attachment of jewelry;

adjusting or repositioning the second disc on the second ear, as needed, until the second disc is positioned at a desired location for the piercing of the second ear and/or if the location of the first disc is at a desired location for the piercing with respect to the position of the second disc, then repositioning one or both discs until the location of each is at a desired location for the piercing; and when each disc is positioned at a desired location for the piercing, marking the ears through the holes or slits in the discs to indicate the locations for piercing the ears, for the wearing or attachment of jewelry.

3. The method of claim 2 wherein the ears are to have multiple piercings for the wearing or attachment of jewelry and the steps of the method are applied for each location of the piercings or intended piercings so that each location may be compared one with the other.

4. The method of claim 2 wherein multiple piercings of each ear are to be done for the wearing or attachment of jewelry and the steps of the method are applied for each location before any of the piercings so that each location may first be compared one with the other.

5. The method of claim 2 wherein the portion of the ears to be pierced are the earlobes.

6. The method of claim 1 wherein selecting the first disc comprises respectively positioning at least two discs of different sizes on the ear and choosing the disc having the desired size.

7. The method of claim 6 wherein at least four discs are considered, having different sizes in the range of about 5 mm to about 8 mm in diameter.

8. The method of claim 1 wherein the disc is round, flat, and thin in shape and comprises a central hole sized for receipt of a marker tip.

9. The method of claim 1 wherein the disc is round, flat, and thin in shape and comprises at least two slits perforating the disc and extending radially and equidistant from the center of the disc, but not perforating the center of the disc, so that the slits appear to point toward the center of the disc.

10. The method of claim 1 wherein the disc adheres to the ear with reusable adhesive.

11. The method of claim 1 wherein the disc adheres to the ear through an affinity of the material comprising the disc with skin.

12. The method of claim 1 further comprising removing the disc after said marking and prior to piercing the ear.

13. The method of claim 1 wherein the portion of the ear to be pierced is the earlobe.

14. The method of claim 1 wherein the ear is to have multiple piercings, for the wearing or attachment of jewelry, and the steps of the method are applied for each location of the piercings or intended piercings so that each location may be compared one with the other.

15. The method of claim 1 wherein multiple piercings of the ear are to be done for the wearing or attachment of jewelry and the steps of the method are applied for each location before any of the piercings so that each location may first be compared one with the other.

16. The method of claim 1 wherein the body part to be pierced is an eyebrow; cheek, or nose.

17. A method for piercing an ear, or other part of a user's head or face, at a desired location, for the wearing or attachment of jewelry, the method comprising:

selecting a first disc simulating a stud earring and having a central hole indicating the center of the disc;

positioning the disc on the first ear, or said other part, so that the disc adheres to the ear, or said other part;

viewing the ear, or said other part, wearing the disc, to determine whether the disc is positioned at a desired location for the piercing of the ear, or said other part, for the wearing or attachment of jewelry;

adjusting or repositioning the disc on the ear, or said other part, as needed, until the disc is positioned at a desired location for the piercing of the ear, or said other part, for the wearing or attachment of jewelry; and when the disc is positioned at the desired location for said piercing, using the disc as a template, piercing the ear, or said other part, through the central hole of the disc, for the wearing or attachment of jewelry.

18. The method of claim 17 wherein a needle that fits through the central hole of the disc is used for the piercing.

19. The method of claim 17 further comprising removing the disc after the piercing.

* * * * *